United States Patent [19]

Searson

[11] Patent Number: 4,545,083

[45] Date of Patent: Oct. 8, 1985

[54] BATHING SPRAY APPARATUS

[76] Inventor: Thomas E. Searson, 4808 Mill Reef Rd., Richmond, Va. 23150

[21] Appl. No.: 608,434

[22] Filed: May 9, 1984

[51] Int. Cl.[4] ..... B05B 1/04; B05B 1/18

[52] U.S. Cl. ..... 4/615; 4/596; 4/570; 239/556; 239/589

[58] Field of Search ..... 4/601, 604, 605, 615, 4/567, 570, 596, 559, 568, 569; 239/556, 557, 589, 601; 248/188.5; 403/386; 165/170

[56] References Cited

U.S. PATENT DOCUMENTS

| | | | |
|---|---|---|---|
| 1,737,989 | 12/1929 | Wollenschlager | 403/386 |
| 1,762,313 | 6/1930 | Snow et al. | 239/589 |
| 2,663,178 | 12/1953 | Schwartz | 4/559 |
| 2,806,723 | 9/1957 | Fairclough | 248/188.5 |
| 2,949,109 | 8/1960 | Koolnis | 4/615 |
| 3,415,259 | 12/1968 | Noren et al. | 239/556 |
| 3,814,399 | 6/1974 | Melreit | 4/559 |
| 3,913,839 | 10/1975 | Wilson | 239/267 |
| 4,286,365 | 9/1981 | Creighton | 165/170 |

*Primary Examiner*—Stephen Marcus
*Assistant Examiner*—Linda J. Sholl
*Attorney, Agent, or Firm*—John F. C. Glenn

[57] ABSTRACT

Water for bathing is sprayed from a hollow plate having a series of internal channels and a corresponding series of rows of openings from the channels through one face of the plate.

2 Claims, 10 Drawing Figures

BATHING SPRAY APPARATUS

BACKGROUND OF THE INVENTION

Conventional showers for bathing provide relatively small sprays of water capable of bathing only one person at a time. Known shower means are illustrated, for example, in U.S. Pat. Nos. 1,860,968 (Tracy), 3,962,733 (Parry), 3,971,074 (Yfeldt), and 4,122,558 (Di Liberto et al.)

SUMMARY OF THE INVENTION

The present invention is based on the underlying concept of providing a even flow of water sufficient to amply cover the entire body of one person, for greater enjoyment, or to permit two persons at once to use the same shower at one time, for greater efficiency and energy savings. Simply enlarging known designs would provide a greater amount and spread of water, but would also increase the amount of water in the pipeline and thus slow response to adjustment of the conventional hot and cold water control valves. Also, conventional shower arrangements are not designed for enlargement of the nozzles to accomplish the said effect.

In accordance with the present invention, these objects are attained by providing a new form of shower nozzle characterized by spray openings arranged in rows, and by a separate water supply channel to each row of the openings. In this way the water can be directed efficiently to the openings with a minimum amount of water in the supply line. A flow restrictor may be inserted in the coupling to the supply line, for economy in use of water. The openings are preferably arranged in a rectangular plane a little longer than it is wide, to give the most desirable spray pattern and to fit most conveniently between a pair of parallel support bars. These bars preferably have suction cups at their opposite ends for purposes of securing the bars between the pair of opposite walls in a shower stall or over a bath tub.

Other objects, details and advantages of the invention will become apparent as the following description of the present preferred embodiment proceeds.

BRIEF DESCRIPTION OF THE DRAWINGS

The accompanying figures schematically illustrate a present preferred embodiment of the invention, as follows.

DETAILED DESCRIPTION OF PRESENT PREFERRED EMBODIMENT

Figure 1:
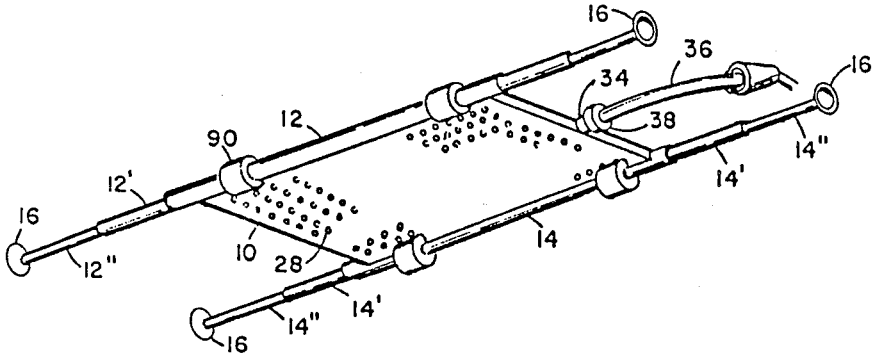
FIG. 1 is an isometic perspective view, from below, of a spray plate and its support extending between two opposite walls (not shown) and its connection to a conventional water supply outlet.
Figure 2:
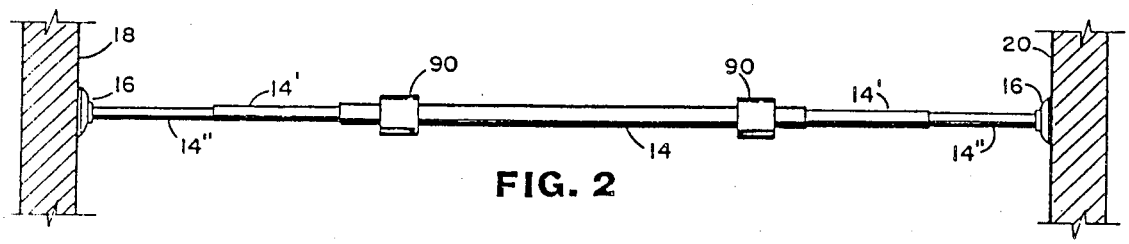
FIG. 2 shows a side view of the apparatus shown in FIG. 1, including the said opposite walls (partially broken away)
Figure 3:
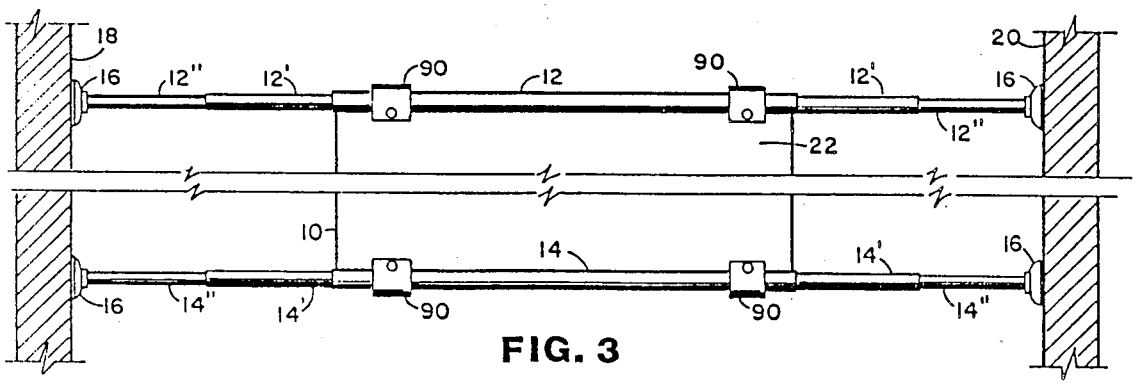
FIG. 3 shows a top plan view of the apparatus shown in FIG. 2.

Referring now more particularly to the drawings and initially to FIG. 1, there is shown a rectangular spray plate 10 having its longer side supported between a pair of parallel tubular bars 12 and 14. The bar 12 has extensible telescoping projections 12' and 12" at its opposite ends, and the bar 14 has corresponding projections 14' and 14" at its opposite ends. Spring buttons 15 lock each of the telescoping projections when it reaches each of the opposite ends of its desired movement to adjust to standard wall spacings (such as 3 feet, 4 feet, and 5 feet between walls). A flexible suction cup 16 is mounted at each of the outer ends of the projections 12' and 14', to secure the assembly to a pair of opposing walls 18 and 20 (FIGS. 2 and 3). Springs 21 within bars 12" and 14" press resiliently outwardly against cups 16, to urge them yieldably outwardly and thus position and hold them against walls 18 and 20.

Figure 4:
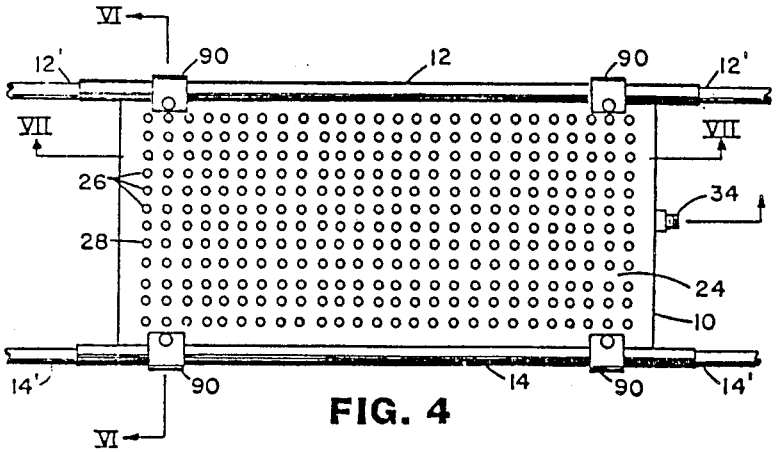
FIG. 4 shows a bottom plan view of the spray plate and adjacent portions of the support bars shown in FIGS. 2 and 3, with the other structure broken away.

The plate 10 is mounted horizontally, and has an unbroken flap top surface 22 and a flat lower surface 24 perforated by several rows 26 of openings 28 (FIGS. 3 and 4). The plate 10 has upper and lower parts secured together around their peripheries. The upper part is preferably in the form of a rectangular plate member **20*a*, which is solid between parallel upper and lower surfaces. The lower part is preferably in the form of a rectangular member 20*b*** which is cast from a suitable plastic material. A plastic material which is transparent or at least translucent is preferred for this purpose, such as an acrylic resin. However, other materials can be used, including opaque materials, and those formed by machining instead of casting.

Figure 5:
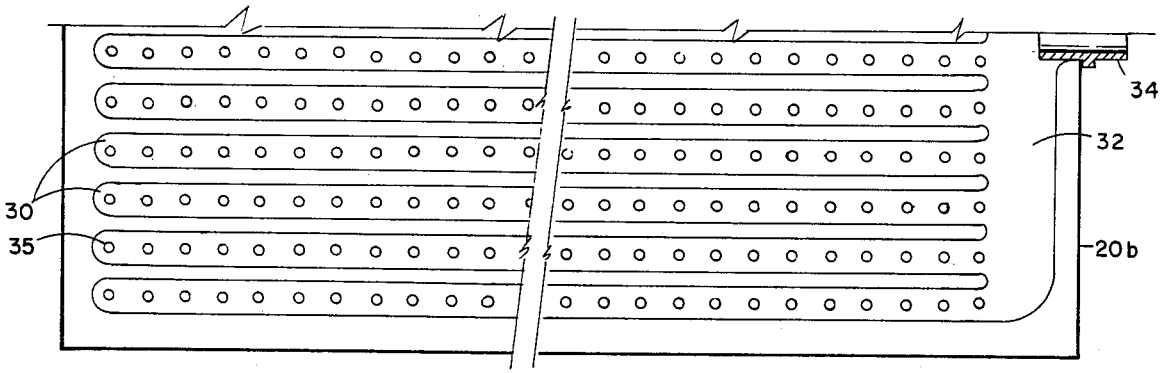
FIG. 5 shows an enlarged top plan view of the plate and associated parts shown in FIG. 4.

Plate member **20*b* is solid except where it is indented from the top to form a series of channels 30 extending parallel to the longer sides of plate 10, to pierce a row 26 of openings 28 through the bottom of each of the channels 30, and to form a header space 32 connecting one set of ends of the channels 30 with one end of a connector tube 34 cast into one end of plate member 20*b* (FIG. 5). The channels and header space are closed at the top when plate 20*a* is secured over plate member 20*b*, and their volume is made no larger than what is necessary to convey enough water to openings 28** for the showering purposes of the invention.

Figure 6:
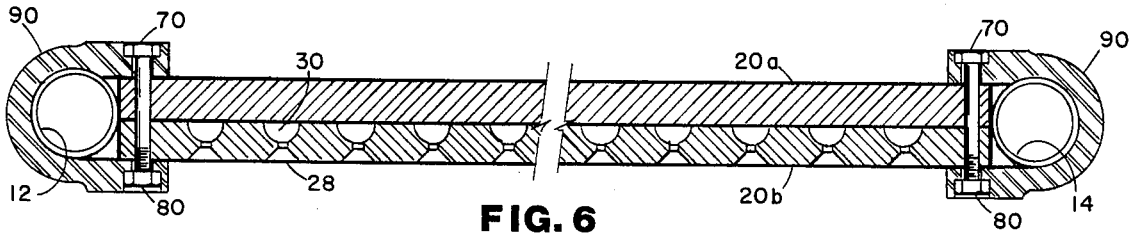
FIG. 6 shows an enlarged and partially broken away section on the line VI—VI in FIG. 4.
Figure 7:
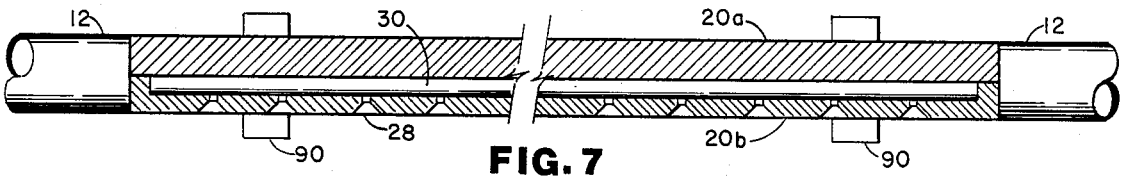
FIG. 7 is an enlarged and partially broken away section on the line VII—VII shown in FIG. 4.
Figure 8:
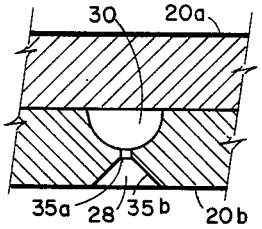
FIG. 8 shows a further enlarged detailed view, partially broken away, of the section shown in FIG. 6.
Figure 9:
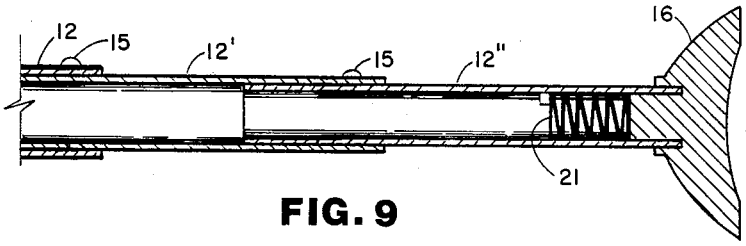
FIG. 9 shows an enlarged and partially broken away view of a section through the central axis of one end of one of the support bars and its telescoping extensions and suction cup.

As shown in FIGS. 6 and 7, each of the openings 28 is preferably made relatively small at its inner end, where it receives water from the adjacent channel 30, and expanding toward its exit through the lower surface of plate member **20*b* (FIG. 8). This shape of each opening 28 preferably begins with a small opening 35*a* extending down from a channel 30 and expanding into the form of a truncated cone 35*b* at its lower end. This gives these openings the effect of a large number of individual nozzles when showering through plate 10. The size and direction of the openings 35*a*** may be uniform or may alternate between a larger size and a smaller size and/or between straight down and at an angle, for special spray effects.

Figure 10:
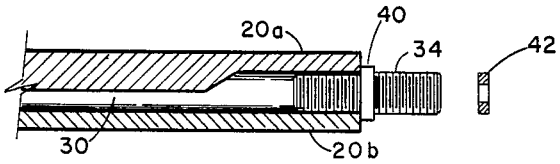
FIG. 10 shows an enlarged and partially broken away view of a section taken on the line X shown in FIG. 4.

The connector tube 34 is secured to a flexible conduit 36, having a coupling 38 adapted to be secured to the end of a conventional fixed water pipe after the conventional shower nozzle has been removed. It is thus easy to mount plate 10 where desired. An integral stop 40 on tube 34 is useful in securing it in place. A water flow restrictor disc 42 (FIG. 10) may be inserted when connecting tube 34 to conduit 36, or when connecting the other end of conduit 36.

The bars 12 and 14 are preferably secured to plate 10 by means of clamps 90 each secured by a bolt 70 extending from one end of the clamp through plate members 20*a* and 20*b* to a nut 80 mounted in the opposite end of the clamp.

Plate 10 may also be used without support bars 12 and 14 and conduit 36, as an insert in an opening made through the preformed top of a fiberglas shower stall.

While present preferred embodiments of the invention have been illustrated and described, it will be understood that it may be otherwise embodied and practiced within the scope of the following claims.

I claim:

1. Shower apparatus for bathing comprising a pair of members superimposed and joined together to form a composite plate having its sides elongated more in one direction than in the transverse direction, said members each being in the form of a plate and one of them having a generally continuous flat face against the opposing face of the other member, the other of said members being of cast plastic material and having indentations into its said opposing face forming a series of side-by-side channels which extend within the composite plate in the direction of said elongation and which terminate at their ends adjacent to one end of the composite plate, and also forming a header space within and adjacent to the other end of the composite plate, said header space being connected to the other ends of the channels, means at said other end of the composite plate for conducting water to the header space, said conducting means being connectable to receive water from a water supply pipe, and said other member having a series of openings spaced along and extending from the respective channels through an exposed face of said other member, said openings having their central axes positioned to extend vertically when the composite plate extends horizontally, and a pair of parallel elongated support members extending along opposite sides of said plate in the direction of elongation of the plate, said support members being extensible and having means at their opposite ends for attachment to vertical wall surfaces, and means extending outwardly from said opposite sides of the plate and connecting it to said support members.

2. Apparatus according to claim 1, in which said openings are formed as part of said cast plastic material and have their exit ends in the form of truncated cones enlarging toward the exit ends.

* * * * *